United States Patent [19]

Murakami

[11] 4,029,749

[45] June 14, 1977

[54] PROCESS FOR MANUFACTURING NEEDLE COKE

[75] Inventor: Hisashi Murakami, Tokyo, Japan

[73] Assignee: Mitsui Coke Co. Ltd., Tokyo, Japan

[22] Filed: Oct. 16, 1975

[21] Appl. No.: 622,897

[30] Foreign Application Priority Data

Nov. 29, 1974 Japan ..... 49-136165

[52] U.S. Cl. ..... 423/449; 208/8; 208/50; 423/445; 423/448

[51] Int. Cl.[2] ..... C01B 31/02; C01B 57/04

[58] Field of Search ..... 423/449, 448, 445; 208/50, 131, 8; 44/1 B

[56] References Cited

UNITED STATES PATENTS

| | | | |
|---|---|---|---|
| 2,775,549 | 12/1956 | Shea | 208/50 X |
| 3,112,181 | 11/1963 | Petersen et al. | 423/448 |
| 3,375,188 | 3/1968 | Bloomer | 208/46 X |
| 3,607,718 | 9/1971 | Leaders et al. | 208/8 |
| 3,617,480 | 11/1971 | Keel | 208/50 |
| 3,617,515 | 11/1971 | Bloomer | 208/131 |
| 3,687,837 | 8/1970 | Fiocco et al. | 208/8 |
| 3,799,865 | 3/1974 | Suetsugu et al. | 208/131 |

*Primary Examiner*—Edward J. Meros

[57] ABSTRACT

A process is disclosed for manufacturing needle coke, which process involves the steps of comminuting a coal, dispersing it in a suitable solvent, subjecting the dispersion to hydrogenolysis liquefaction at 360°–480° C and 1–150 $Kg/Cm^2H_2$ pressure, distilling the resultant ashless coal solution at 250°–600° C to remove impurities, and unreacted coal, and coking selected distillate fractions in a conventional coker.

7 Claims, No Drawings

PROCESS FOR MANUFACTURING NEEDLE COKE

BACKGROUND OF THE INVENTION

The present invention relates to a process for manufacturing needle coke from substantially ashless liquefied coal solutions.

Coke, as the material for electrodes, is presently manufactured from mainly petroleum heavy oil or coal tar pitch. The properties required of such cokes include, among others, suitable strength and specific gravity, an acceptable level of impurities and the proper crystalline structure. With regard to the crystalline structure, some cokes are rich in amorphous substances, while others are rich in needle-like crystals, the former being suitable for producing electrodes for use in aluminum refining, and the latter being more suitable for producing large-sized artificial graphite electrodes.

A large-sized artificial graphite electrode requires low electrical resistance, a small coefficient of thermal expansion, high density and a high level of physical strength, in, order to cope with the operation of a steel-making electric furnace. The material therefor, consequently, should contain a large quantity of the so-called needle coke having a needle-like crystalline structure of easily and readily graphitizable nature.

Hitherto needle coke was manufactured from coal tar pitch, as the specifically suited material; however, there is an insufficiently limited supply of coal tar pitch for the high demand of modern industry. Technological efforts for manufacturing needle coke as well as amorphous coke from heavy fractions of petroleum are presently being conducted, but the presence of abnormally large quantities of impurities, including 300–500ppm of vanadium, 100–500ppm of nickel, and approximately 1000ppm of Fe+Si, in the material still remains a mostly unresolved problem in using heavy petroleum fractions as the source materials.

Ashless coke, on the other hand, manufactured from substantially ashless liquefied coal, that is, manufactured by the processes of solvent extraction of coal or coal hydrogenation has been reported to be exclusively of the amorphous type. More specifically, around 1940, coal was subjected to extraction for refining by the use of fractions of coal tar, and substantially ashless liquefied coal was produced, such ashless coke being found suitable as material for carbon electrodes for electrolysis of aluminum. This was however amorphous coke having properties suitable only for making electrodes to be employed for electrolysis of aluminum.

SUMMARY OF THE INVENTION

An object of the present invention is, therefore, to overcome the amorphous nature of the product of the prior art processes and to provide a needle coke material for use in large-sized artificial graphite electrodes at lower cost than heretofore conventionally possible.

It is another object of the present invention to provide such a needle coke material for large-sized artificial graphite electrodes in such quantity as to be capable of meeting the ever increasing industrial demand therefor.

Briefly stated, in manufacturing of substantially ashless liquefied coal solutions, the coal is subjected to crushing into comminuted particles of about 30 mesh or less and is caused to be dispersed into a solvent produced from coal and having a boiling point of 140° C–400° C at a coal-to-solvent weight ratio of 1:6 to 1:1; the product is then subjected to hydrogenolysis liquefaction in the temperature range of 360–480° C under a pressure of hydrogen of 1–150kg/cm$^2$, and the coal is properly decomposed and liquefied in some 0.5–3.0 hours depending upon the quality of the coal used; the mineral and the unreacted coal contained in the liquefied solution are subsequently subjected to separation in a known manner by the application of one or more conventional processes, including sedimentation, filtration, centrifugation, and distillation; and then the liquefied coal solution thus produced is distilled and subjected to cooking at a temperature of between 450° and 530° C.

DETAILED DESCRIPTION OF THE EMBODIMENT OF THE INVENTION

According to the present invention the substantially ashless liquefied coal solution, with solid impurities originally contained therein properly removed therefrom, is subjected to conventional fractional distillation. The distillate oil thus produced may well be employed as it is as the material for needle coke; however, selection of the distillate fractions obtained in the 250° C–600° C temperature range results in an improvement in the yield of the coker, in the reduction in manufacturing costs and in the production of particularly good needle coke. If distillate fractions obtained at less than 250° C are selected for use, the yield from the coker is low and hence uneconomical; conversely, if distillate cuts obtained at above 600° C are selected for use, the composition of the fractions is diversified, and the coke thus produced is deteriorated in terms of quality.

When the distillate is introduced into a coking apparatus, such as a delayed coker or the like, and is subjected to coking in the temperature range of 450°–530° C for a period of 20–50 hours by the application of a conventional process, green coke of the needle-like crystalline structure is produced. When the green coke is then subjected to calcination in the temperature range of 1300° C–1600° C, needle coke with needle-like crystals fully discernable is produced. If the calcination temperature is below 1300° C, volatile substances will be left in the needle coke and, conversely, if the calcination temperature is above 1600° C, there is the disadvantage that the cost of the calcination equipment will become excessive.

Furthermore, the aforementioned solvent for the coal is a distillate produced from coal and having a boiling point of 140°–400° C or an equivalent to the same. In case of using a solvent having a boiling point of below 140° C, a large quantity of the solvent is needed due to its smaller solubility to coal, and on the contrary, extraction operation will become difficult due to its high viscosity in case of using a solvent having a boiling point of above 400° C. As such a solvent, a heavy oil obtained by coal tar distillation, for example, may be used and equivalent to the same, such as a distillate obtainable by distillation of bottom oil in benzene, toluene and xylene synthesis, may also be employed.

The properties of the needle coke produced by the process of the invention are shown in Tables 2 and 3 following.

When a green electrode is manufactured by the employment of the needle coke of the invention, and is subjected to proper graphitization in the temperature of 2600° C or above, an excellent electrode is produced with a coefficient of linear thermal expansion as low as $0.55\times10^{-6}$(1/° C) and a content of nickel and vanadium impurities of negligible order of magnitude.

Furthermore, now that substantially ashless liquefied coal solution may be specifically selected for use as the material for the process, the capability of supply of the required starting material is raised beyond comparison over the use of the conventional coal tar pitch. And, with further regard to the material for the needle coke made according to the present invention, some heavy oils obtained by coal tar distillation and/or some heavy oils obtained in petroleum refining distillation may well be added by conventional methods to the liquefied coal distillate oil, preferably in the amount of 10–30%.

For the purpose of elucidating the present invention, a description will now be given here below in terms of illustrative examples.

EXAMPLE 1

400g of coal were crushed into comminuted particles of about 30 mesh and less, were caused to be dispersed into a heavy oil obtained by coal tar distillation at a coal-to-oil weight ratio of 1:3 and were then subjected to hydrogenolysis liquefaction at a temperature of 400° C and at a pressure of hydrogen of 80kg/cm². The mineral and the unreacted coal were removed from the liquefied coal solution thus produced by filtration. The light solvent was recovered from the substantially ashless coal solution by distillation, and 320g of substantially ashless liquefied coal solution were obtained.

The 300° C–600° C fractions of the distillate were separated from the liquefied coal solution and were introduced into a bench-scale coking apparatus and were subjected to coking in the temperature range of 499° C–502° C for a period of 21 hours; 160g of green coke were obtained.

The structure of the green coke was definitely needle-like crystalline.

The product obtained from the green coke by subjecting the same to calcination in the temperature range of 1300° C–1400° C, in the absence of air flows, was needle coke with needle-like crystals clearly discernable by naked eye. A green electrode was then manufactured by using said needle coke and was subjected to graphitization at temperature of 2600° C and above. Such electrode had a coefficient of thermal linear expansion of $0.55=10^{-6}$(1/° C).

The analytical values of the liquefied coal solution employed are shown in Table 1, and the properties of the calcined coke produced by calcining the green coke in the temperature range of 1300° C–1400° C are shown in Table 2.

Table 1

| | |
|---|---|
| Specific gravity (25° C/4° C) | 1.16 |
| Insoluble content to benzene (%) | 19 |
| Insoluble content to quinoline (%) | 0.1 max. |
| Ash (%) | 0.1 max. |
| Softening point (° C) | 133 |
| H/C | 0.88 |

Table 2

| | |
|---|---|
| Appearance | Needle-like |
| Specific gravity (25° C/4° C) | 2.14 |
| Fixed carbon (%) | 99.5 |
| Volatile matter (%) | 0.3 |
| Sulfur (%) | 0.2 |
| Ash (%) | 0.1 |
| Ni (ppm) | 0.4 |
| V (ppm) | 0.1 |

Table 2-continued

| | |
|---|---|
| Fe + Si (ppm) | 400 |

EXAMPLE 2

The substantially ashless liquefied coal solution obtained in Example 1 was subjected to distillation and distillate fractions of 250° C–550° C were introduced into a bench-scale coking apparatus, and coked at the temperature of 495° C by keeping said fractions intact for a period of 24 hours. The green coke thus obtained had a needle-like crystalline structure, like in the previous example.

EXAMPLE 3

The fractions of 300° C–600° C obtained in Example 1 were mixed with, by weight, 10% of coal tar pitch (softening point 80° C), were introduced into a bench-scale coking apparatus and coked in the temperature range of 495° C–500° C by keeping the fractions intact for a period of 23 hours. The green coke has, again, a needle-like crystalline structure.

The properties of the calcined coke produced by calcining the green cokes obtained in Examples 2 and 3 in the temperature range of 1300° C–1400° C are shown in Table 3.

Table 3

| | Example 2 | Example 3 |
|---|---|---|
| Appearance | Needle-like | Needle-like |
| Specific gravity (25° C/4° C) | 2.15 | 2.13 |
| Fixed carbon (%) | 99.5 | 99.4 |
| Volatile matter (%) | 0.2 | 0.3 |
| Sulfur (%) | 0.2 | 0.2 |
| Ash (%) | 0.1 | 0.1 |
| Ni (ppm) | 0.3 | 0.3 |
| V (ppm) | 0.1 | 0.1 |
| Fe + Si (ppm) | 350 | 560 |

CONTROL

The liquefied coal solution obtained in Example 1 was coked in a bench-scale coking apparatus, without subjecting the solution to distillation. When the green coke thus obtained was subjected to calcination in an electric furnace at the temperature of 1350° C, amorphous coke was obtained, which proved nevertheless to possess excellent properties in terms of material suitable for manufacturing electrodes for the electrolysis of aluminum.

What is claimed is:

1. A process for manufacturing needle coke which comprises crushing coal into comminuted particles; dispersing said comminuted particles into a suitable solvent; subjecting the dispersed particles to hydrogenolysis liquefaction at 360° –480° C and 1–150 Kg/Cm² of hydrogen pressure to obtain a liquefied coal solution; distilling the substantially ashless liquefied coal solution thus obtained at 250°–600° C to remove solid impurities and unreacted coal therefrom; and coking at least one selected distillate fraction of said distillation in a coking apparatus.

2. The process of claim 1, wherein said crushing results in particles of 30 mesh size and smaller, said solvent is a distillate produced from coal and having a boiling point of between 140° and 400° C, and said coking is effected at temperatures of between 450° and 530° C.

3. The process according to claim 1, wherein a heavy oil obtained by coal tar distillation is added to said distillate fraction prior to coking.

4. The process according to claim 1, wherein a heavy oil obtained by petroleum distillation is added to said distillate fraction prior to coking.

5. The process according to claim 4, wherein said distillate fraction is coked at 450°–430° C for a period of 20–50 hours.

6. The process according to claim 1, wherein said distillate fraction is coked at 450°–530° C for a period of 20 14 50 hours.

7. The process according to claim 1, further comprising the step of calcining the coked distillate fraction at a temperature of 1300° –1600° C.

* * * * *